US006537406B1

(12) United States Patent
Jensen, Jr. et al.

(10) Patent No.: US 6,537,406 B1
(45) Date of Patent: Mar. 25, 2003

(54) VACUUM-ASSISTED TAPE APPLICATOR

(75) Inventors: Van E. Jensen, Jr., Stillwater, MN (US); Michael R. Mitchell, St. Paul, MN (US); Lloyd S. Vasilakes, Stillwater, MN (US); David C. Bernard, Cottage Grove, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/541,921

(22) Filed: Apr. 3, 2000

(51) Int. Cl.[7] ..... B65B 51/06

(52) U.S. Cl. ..... 156/202; 156/285; 156/468; 156/487; 156/522; 156/530

(58) Field of Search ..... 156/202, 285, 156/286, 295, 381, 382, 468, 486, 487, 510, 522, 530, DIG. 42; 53/136.4

(56) References Cited

U.S. PATENT DOCUMENTS

| | | | | |
|---|---|---|---|---|
| 2,492,908 | A | | 12/1949 | Von Hofe |
| 2,532,011 | A | | 11/1950 | Dahlquist et al. |
| 2,607,711 | A | | 8/1952 | Hendricks |
| 2,788,625 | A | | 4/1957 | Larsen et al. |
| 2,990,081 | A | | 6/1961 | De Neui et al. |
| 3,318,852 | A | | 5/1967 | Dixon |
| 3,502,497 | A | | 3/1970 | Crocker |
| 3,561,190 | A | | 2/1971 | Derenthal |
| 3,625,794 | A | | 12/1971 | Arikawa et al. |
| 3,657,051 | A | | 4/1972 | McCarthy |
| 3,905,859 | A | | 9/1975 | Patterson |
| 3,963,557 | A | | 6/1976 | Patterson |
| 4,001,072 | A | | 1/1977 | De Neui |
| 4,072,224 | A | | 2/1978 | Barnaby et al. |
| 4,161,138 | A | | 7/1979 | Marchetti |
| 4,200,483 | A | | 4/1980 | Hoveler |
| 4,227,955 | A | | 10/1980 | Woods et al. |
| 4,241,198 | A | | 12/1980 | Kobayashi |
| 4,256,528 | A | | 3/1981 | Patterson |
| 4,321,103 | A | | 3/1982 | Lindstrom et al. |
| 4,388,143 | A | | 6/1983 | Buchholz et al. |
| 4,389,009 | A | | 6/1983 | Yamashita |
| 4,406,730 | A | * | 9/1983 | Altmix ..... 156/574 |
| 4,421,817 | A | | 12/1983 | Pina et al. |
| 4,427,144 | A | | 1/1984 | Macgrory et al. |
| 4,432,830 | A | | 2/1984 | Jue |
| 4,577,199 | A | | 3/1986 | Saiki et al. |

(List continued on next page.)

FOREIGN PATENT DOCUMENTS

| | | |
|---|---|---|
| CH | 687 193 | 10/1996 |
| DE | 32 34 556 A1 | 5/1984 |

(List continued on next page.)

OTHER PUBLICATIONS

US 4,909,885, 3/1990, Swenson (withdrawn)
N. Draper & H. Smith, *Applied Regression Analysis*, 2nd Ed., Chapters 2 and 6 (1966).

(List continued on next page.)

*Primary Examiner*—Michael W. Ball
*Assistant Examiner*—John T. Haran
(74) *Attorney, Agent, or Firm*—Melissa E. Buss

(57) ABSTRACT

A vacuum-assisted tape applicator includes means for transporting the tape toward the object; means for applying the tape onto adjacent first and second sides of the object; and means for cutting the tape to form a tag. The means for applying includes means for contacting the tape to the first side of the object with the longitudinal centerline of the tape substantially perpendicular to the common edge; means for contacting the tape to the second side of the object with the longitudinal centerline of the tape substantially parallel to the direction of object travel; and means for wiping the tape from the longitudinal centerline toward the transverse edges to minimize bubbles under the tape and wrinkles in the tape. The apparatus can include means for holding the tape during application. The length of the leading leg of the tag can be adjusted and the applying force can also be adjusted to reduce crushing the corners of the object.

18 Claims, 6 Drawing Sheets

U.S. PATENT DOCUMENTS

| | | | | |
|---|---|---|---|---|
| 4,676,859 | A | | 6/1987 | Cleary, Jr. et al. |
| 4,707,211 | A | | 11/1987 | Shibata |
| 4,717,621 | A | | 1/1988 | So et al. |
| 4,728,571 | A | | 3/1988 | Clemens et al. |
| 4,784,714 | A | | 11/1988 | Shibata |
| 4,807,177 | A | | 2/1989 | Ward |
| 4,815,871 | A | | 3/1989 | McGourty et al. |
| 4,839,742 | A | | 6/1989 | Nakatani et al. |
| 4,857,134 | A | | 8/1989 | Lin |
| 4,889,581 | A | | 12/1989 | Ulrich et al. |
| 4,942,212 | A | | 7/1990 | Hanada et al. |
| 5,032,460 | A | | 7/1991 | Kantner et al. |
| 5,037,219 | A | | 8/1991 | Duport |
| 5,040,461 | A | | 8/1991 | Van-Ocker |
| 5,053,436 | A | | 10/1991 | Delgado |
| 5,121,586 | A | | 6/1992 | Focke |
| 5,168,814 | A | | 12/1992 | Kuzuya et al. |
| 5,193,926 | A | | 3/1993 | Kuzuya et al. |
| 5,202,190 | A | | 4/1993 | Kantner et al. |
| 5,209,808 | A | | 5/1993 | Booth |
| 5,214,119 | A | | 5/1993 | Leir et al. |
| 5,227,002 | A | | 7/1993 | Faust et al. |
| 5,242,888 | A | | 9/1993 | Atherton et al. |
| 5,261,996 | A | | 11/1993 | Rossini |
| 5,286,332 | A | | 2/1994 | Rossini |
| 5,286,682 | A | | 2/1994 | Jacobs et al. |
| 5,290,615 | A | | 3/1994 | Tushaus et al. |
| 5,292,713 | A | | 3/1994 | Stenzel et al. |
| 5,295,753 | A | | 3/1994 | Godo et al. |
| 5,302,034 | A | | 4/1994 | Kitazawa |
| 5,308,173 | A | | 5/1994 | Amano et al. |
| 5,328,754 | A | | 7/1994 | Yuyama et al. |
| 5,354,588 | A | | 10/1994 | Mitchell et al. |
| 5,356,706 | A | | 10/1994 | Shores |
| 5,376,418 | A | | 12/1994 | Rogers et al. |
| 5,379,962 | A | | 1/1995 | Albrecht et al. |
| 5,399,036 | A | | 3/1995 | Yamaguchi |
| 5,419,648 | A | | 5/1995 | Nagao et al. |
| 5,425,823 | A | | 6/1995 | Woodside, III |
| 5,431,763 | A | | 7/1995 | Bradshaw |
| 5,437,228 | A | | 8/1995 | Uland |
| 5,443,318 | A | | 8/1995 | Kitazawa |
| 5,461,133 | A | | 10/1995 | Hammar et al. |
| 5,478,880 | A | | 12/1995 | Shipston et al. |
| 5,482,593 | A | | 1/1996 | Kuhn et al. |
| 5,487,337 | A | | 1/1996 | Uland |
| 5,494,360 | A | | 2/1996 | Watanabe et al. |
| 5,497,701 | A | | 3/1996 | Uland |
| 5,503,485 | A | | 4/1996 | Nakazato |
| 5,524,996 | A | | 6/1996 | Carpenter et al. |
| 5,531,853 | A | | 7/1996 | Cubow et al. |
| 5,540,369 | A | | 7/1996 | Boreali et al. |
| 5,543,192 | A | | 8/1996 | Shipston et al. |
| 5,549,783 | A | | 8/1996 | Schroeder et al. |
| 5,560,293 | A | | 10/1996 | Boreali et al. |
| 5,569,515 | A | | 10/1996 | Rice et al. |
| 5,571,617 | A | | 11/1996 | Cooprider et al. |
| 5,614,928 | A | | 3/1997 | Matsuda et al. |
| 5,621,020 | A | | 4/1997 | Khatib et al. |
| 5,621,030 | A | | 4/1997 | Shipston et al. |
| 5,658,647 | A | | 8/1997 | Magill et al. |
| 5,661,099 | A | | 8/1997 | Stabinsky |
| 5,674,345 | A | | 10/1997 | Nash |
| 5,674,626 | A | | 10/1997 | Khatib et al. |
| 5,675,369 | A | | 10/1997 | Gaskill |
| 5,692,896 | A | | 12/1997 | Pospisil et al. |
| 5,750,004 | A | | 5/1998 | Wurz et al. |
| 5,750,630 | A | | 5/1998 | Sengupta |
| 5,782,496 | A | | 7/1998 | Casper et al. |
| 5,814,184 | A | * | 9/1998 | Denkins ..... 156/577 |
| 5,832,827 | A | | 11/1998 | Pistro et al. |
| 5,857,789 | A | | 1/1999 | Day et al. |
| 5,874,499 | A | | 2/1999 | Shipston et al. |
| 5,879,507 | A | | 3/1999 | Schroeder et al. |
| 5,940,107 | A | | 8/1999 | Fox |
| 5,997,193 | A | | 12/1999 | Petterutti et al. |
| 6,007,263 | A | | 12/1999 | Imai et al. |
| 6,049,347 | A | | 4/2000 | Ewert et al. |
| 6,067,103 | A | | 5/2000 | Ewert et al. |

FOREIGN PATENT DOCUMENTS

| | | | |
|---|---|---|---|
| DE | 3 727 667 | | 3/1989 |
| DE | 44 12 091 | A1 | 10/1995 |
| DE | 195 35 535 | | 3/1997 |
| DE | 1 960 9431 | | 9/1997 |
| EP | 0096841 | | 12/1983 |
| EP | 9 170172 | | 2/1986 |
| EP | 0 397 379 | B1 | 11/1990 |
| EP | 0579423 | | 1/1994 |
| EP | 0579430 | | 1/1994 |
| EP | 0613787 | | 9/1994 |
| EP | 0 637 547 | A1 | 2/1995 |
| EP | 0673839 | | 9/1995 |
| EP | 0688008 | | 12/1995 |
| EP | 0 763 471 | | 3/1997 |
| EP | 00 905 210 | | 9/1997 |
| EP | 0 834 404 | A2 | 4/1998 |
| EP | 0 854 051 | A1 | 7/1998 |
| GB | 2 243 135 | | 10/1991 |
| GB | 2325453 | | 11/1998 |
| JP | 57-32990 | | 2/1982 |
| JP | 10-101043 | | 4/1998 |
| JP | 2000-247508 | | 9/2000 |
| JP | 2001-96814 | | 4/2001 |
| WO | WO 92/07347 | | 4/1992 |
| WO | WO 93/09195 | | 5/1993 |
| WO | WO 95/21224 | | 8/1995 |
| WO | WO 95/31800 | | 11/1995 |
| WO | WO 96/10489 | | 4/1996 |
| WO | WO 96/21557 | | 7/1996 |
| WO | WO 96/26864 | | 9/1996 |
| WO | WO 96/40508 | | 12/1996 |
| WO | WO 97/05021 | | 2/1997 |
| WO | WO 97/10148 | | 3/1997 |
| WO | WO 97/14616 | | 4/1997 |
| WO | WO 97/15501 | | 5/1997 |
| WO | WO 97/43744 | | 11/1997 |
| WO | WO 97/46389 | | 12/1997 |
| WO | WO 98/42578 | | 10/1998 |
| WO | WO 99/13015 | | 3/1999 |
| WO | WO 99/20468 | | 4/1999 |
| WO | WO 99/54860 | | 10/1999 |
| WO | WO 99/61322 | | 12/1999 |
| WO | WO 00/34131 | | 6/2000 |
| WO | WO 00/76853 | A1 | 12/2000 |

OTHER PUBLICATIONS

Irvine Skeist, *Handbook of Adhesives*, 2nd Ed., p. 102 (1977).

*Research Disclosure*, Nov. 1994, No. 367.

Bill Meyer & Saltzman, *Principles of Color Technology*, 2nd Ed., pp. 62–65 (1981).

Encyclopedia of Polymer Science and Engineering, vol. 13, Wiley–Interscience Publishers (New York, 1988).

Encyclopedia of Polymer Science and Technology, vol. 1, Interscience Publishers (New York, 1964).

3M Innovative Properties Co., "3M–Matic™ Corner Label Applicator CA2000" Brochure, © 1999.

* cited by examiner

VACUUM-ASSISTED TAPE APPLICATOR

TECHNICAL FIELD

The present invention relates to tape applicators. More particularly, the present invention relates to tape applicators for applying tape onto boxes.

BACKGROUND OF THE INVENTION

Containers, packages, cartons, and cases, (referred to as "boxes") for storing and shipping products typically use an adhesive tape, such as box sealing tape, to secure the flaps or covers so that the box will not accidentally open during normal shipment, handling, and storage. Box sealing tape maintains the integrity of a box throughout its entire distribution cycle. Box sealing tape and other adhesive tapes can be used on other parts of boxes and on other substrates and can be used to function similarly to labels. These tapes can be made in roll or pad form. They can be transparent, translucent, or opaque, and can have information printed or otherwise applied to the tape.

Boxes generally contain information about the contents. This information, most commonly located on the box, might include lot numbers, date codes, product identification information, and bar codes. The information can be placed onto the box using a number of methods. These might include preprinting the box when it is manufactured, printing this information onto the box at the point of use with an inkjet coder that sprays a pattern of ink dots to form the image, or by using a flexographic ink rolling coder system. Other approaches include using labels, typically white paper with preprinted information either applied manually, or with an online automatic label applicator.

A recent trend in conveying information related to the product is the requirement to have the information specific for each box. For example, each box could carry specific information about its contents and the final destination of the product, including lot umbers, serial numbers, and customer order numbers. The information is typically provided on labels which are customized and printed on demand at the point of application onto the box. This is typically known as the ability to print variable information onto a label before it is applied onto the box. Two patents that disclose printed labels are U.S. Pat. Nos. 5,292,713 and 5,661,099.

Another approach to place information onto a box is to use tape, which can be preprinted or printed on demand, with fixed information or with variable information. The tape can be applied anywhere on the box by known applying systems. In one system, the tape is applied on the corner of a box by a corner applicator. As used in this application, corner refers to the linear edge that is common between two adjacent sides of a box. Two examples of such an applicator are disclosed in U.S. Pat. Nos. 5,209,808 and 5,227.002. Additionally, printable tapes for applying on boxes, such as those disclosed in U.S. Pat. Nos. 4,421,817; 5,242,888; 5,354,588; 5,478,880; and 5,560,293, are known.

Minnesota Mining and Manufacturing Company of St. Paul, Minn. (3M) has sold an automatic system for applying pre-printed tape (with non-variable information) with bar codes since 1994. This system can apply a pre-printed tape onto the corner of a box while the box is conveyed through a case sealer, or it can apply pre-printed tape onto a flattened box before the box is assembled. This system offers an inexpensive, simple alternative to linered labels.

Various vacuum pad, vacuum belt, and vacuum wheel applicators for pressure sensitive adhesive tapes in which the non-adhesive side of the tape is retained to an applicator wheel by a vacuum are known. In a vacuum wheel system, the vacuum wheel typically maintains control of the tape while it is dispensed, cut, and during the application process. Various vacuum wheel tape applicators are disclosed in U.S. Pat. Nos. 2,990,081; 3,905,859; 3,963,557; 4,001,072; 4,256,528; 4,909,885; and 5,261,996. The vacuum wheel rotates or moves on an arm, as necessary, to position the tape segment. The wheel moves between a first position in which the wheel receives a tape segment and a second position in which the tape segment is applied onto a surface, such as a box. A controller can be used to govern when the vacuum wheel is moved to the second position to apply the tape segment, for how long the vacuum wheel resides adjacent the surface, and when the vacuum wheel returns to the first position to receive another tape segment.

Corner label applicators are currently marketed, such as the LSI Model 2000 (available from Labeling Systems Inc. of Oakland, N.J.) and the Diagraph® PA/4000 Series Label Printer Applicator (available from Diagraph Corporation of St. Louis, Mo.). These label applicators can apply pre-cut tags around corners of objects. The LSI Applicator holds the precut tag by vacuum. However, in neither of these systems is the end of a tape held in place by a vacuum pad to accurately contact the uncut tape to the side of an object. U.S. Pat. No. 4,676,859 assigned to Labeling Systems Inc. describes using vacuum to hold peeled labels. When the labels are to be applied, a blast of compressed air overcomes the vacuum and places the label on the desired surface, even if that surface is several inches away. In other known systems, the label is applied to the box and the bond between the adhesive and the box is stronger than the force created by the vacuum, so the label leaves the applicator and is applied.

Other known label applicators that use vacuum (and some that do not) apply the label by moving the label to the box, generally in a direction perpendicular to the surface of the box. The label is on an applying member with translates toward the box and away from the box.

SUMMARY OF THE INVENTION

The invention is an apparatus and method for applying a length of tape onto at least one side of an object. The apparatus includes means for transporting the tape toward the object; means for applying the tape onto the side of the object; and means for cutting the tape. The applying means includes contacting the tape to the side of the object and wiping the tape from the longitudinal centerline toward the transverse edges to minimize bubbles under the tape and wrinkles in the tape. The apparatus can also include means for holding the tape during application.

In a modification, the apparatus can apply tape onto adjacent sides of an object. This apparatus includes a base; means, mounted on the base, for transporting the tape toward the object; means for applying the tape onto adjacent first and second sides of the object; and means for cutting the tape to form a tag. The first side and second side of the object have a common edge with the first side substantially perpendicular to the direction of travel of the object and the second side is angled with the first side. The means for applying includes means for contacting the tape to the first side of the object with the longitudinal centerline of the tape substantially perpendicular to the common edge; means for contacting the tape to the second side of the object with the longitudinal centerline of the tape substantially parallel to the direction of object travel; and means for wiping the tape from the longitudinal centerline toward the transverse edges to minimize bubbles under the tape and wrinkles in the tape. An applying roller can be mounted on a pivotable applying arm which pivots in response to the force of the object.

The apparatus can also include means for holding the tape during application. This means can be used in addition to the means for wiping or instead of the means for wiping. This means for holding can optionally include a vacuum pad having an effective vacuum area sufficient to hold the tape in position. Also, an eccentric wrap roller which locates and aligns the tape on the vacuum pad ensures proper orientation of the tape on the object and provides a substantially wrinkle-free tag.

In another modification, the means for wiping includes means for contacting the tape and causing the center of the tape to be applied on the second side of the object before the transverse edges of the tape are applied to the second side of the object. This could include a convex roller which contacts the tape and curves the tape around the surface of the convex roller to cause the center of the tape to be applied on the object before the transverse edges of the tape are applied to the object. Also, a shaft can be located on the base adjacent the object path and a pivoting mounting arm mounted on the shaft. The means for cutting can be mounted on the mounting arm and the convex roller mounted on the shaft. The pivoting mounting arm can have a free end connected to the object to move the means for cutting into the correct cut position.

In a further modification, the means for wiping can include a V-shaped wiper located with respect to the path of the object such that the apex of the V contacts the tape first in the longitudinal center of the tape to cause the center of the tape to be applied on the object before the transverse edges of the tape are applied to the object. The V-shaped wiper can include a brush.

The length of the leading leg of the tag can be adjusted using an adjustable backup roller and an applying arm bumper, both located on the base along the tape path. The position of the applying arm bumper can be adjusted. The applying force can also be adjusted to reduce crushing the corners of the object. This can be accomplished by controlling the amount of vacuum to the vacuum pad or by controlling the amount of tension on the tape.

In the illustrated embodiments, the object is a parallelepipedal box with the first side perpendicular to the direction of object travel, and the second side substantially perpendicular to the first side.

DETAILED DESCRIPTION

Figure 1:
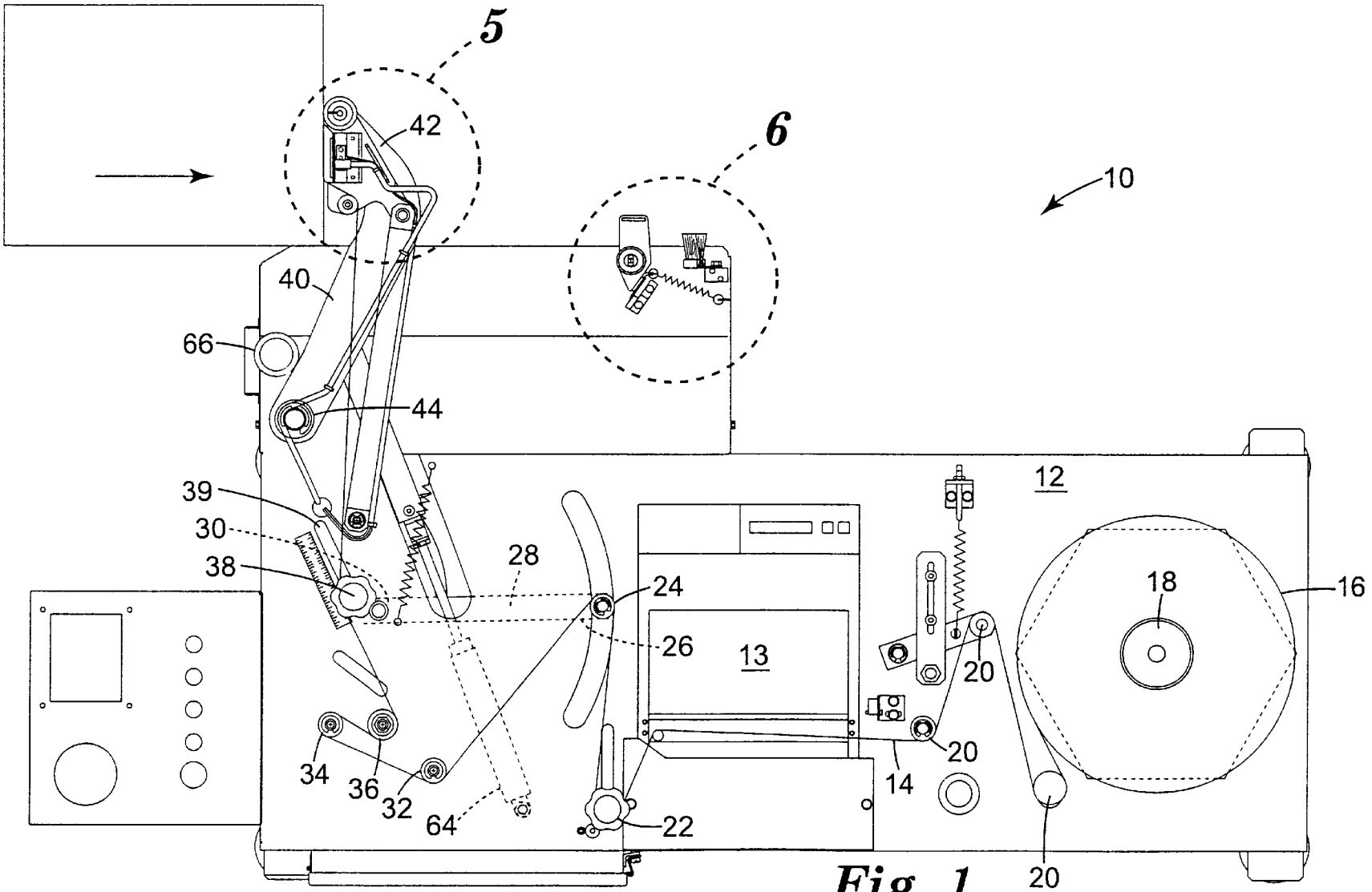
FIG. 1 is a top view of the apparatus of the invention with the various components in the home position.
Figure 2:
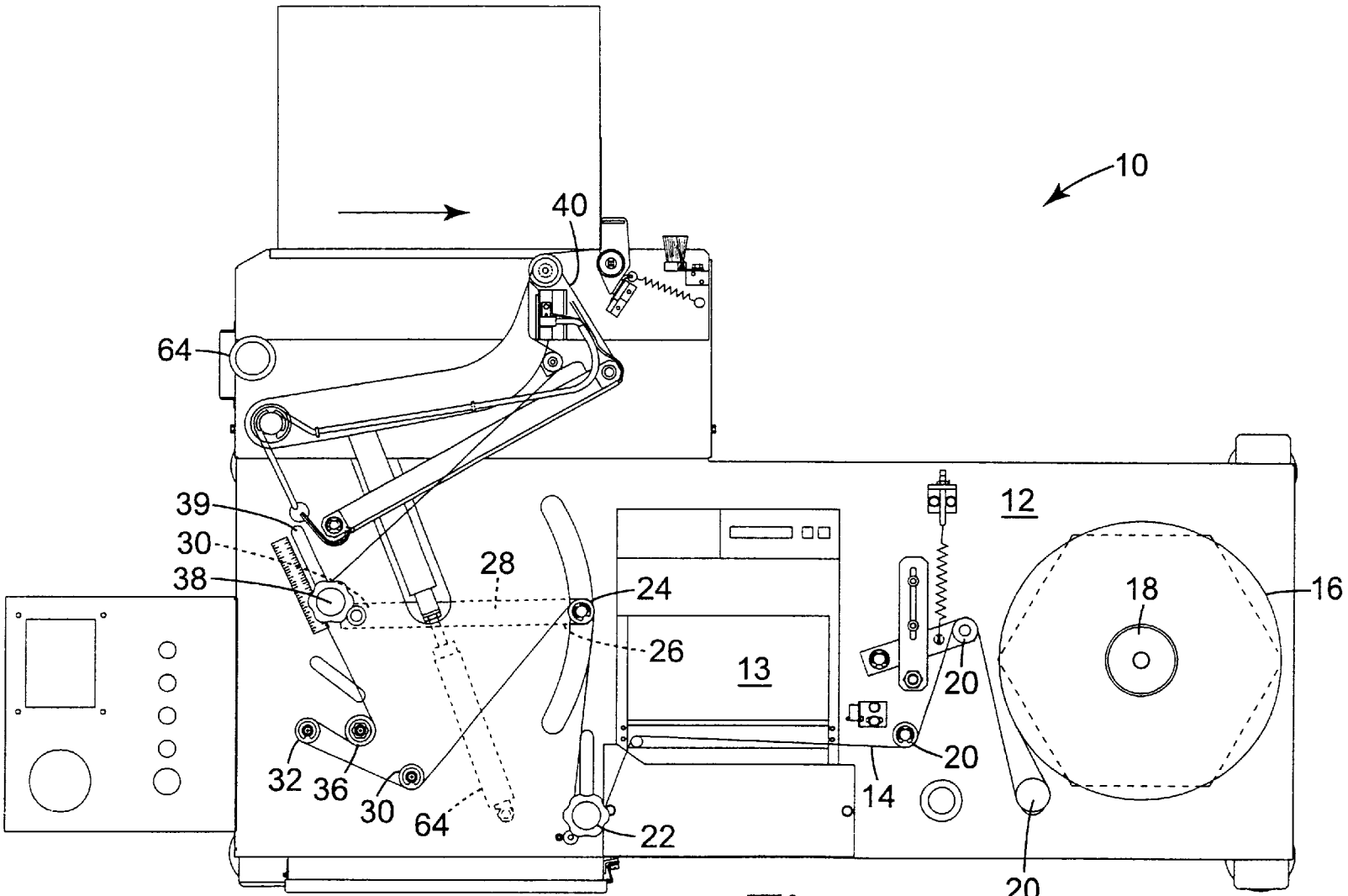
FIG. 2 is a top view of the apparatus of FIG. 1 with a box engaging the applying mechanism.

The apparatus of the invention includes a system for providing information on a surface of an object, such as a box. Throughout this description, the term "tape" is used to mean a construction that can be supplied in a roll form (in which it is self-wound) or other form; and that is not precut. The term "tag" will be used to mean a segment of tape that is severed from the remainder of the tape. The apparatus applies tape to surfaces, such as the two adjacent sides of a box, to apply a corner tag on the box from one supply roll of tape. The system applies the tape, whether printed or not, onto the box while the box is moving (such as while the box is being closed and sealed).

The tape includes a backing and an adhesive layer and can be a single-coated pressure sensitive adhesive tape having a multiple layer construction. The backing layer can be, for example, cloth, paper, metal foil, or plastic film (whether single or multiple layer). Suitable paper backings include saturated flatstock and crepe. Suitable plastic film backings include polypropylene, polyethylene, copolymers of polypropylene and polyethylene, polyvinyl chloride (PVC), polyesters, and vinyl acetates. The polypropylene can include monoaxially-oriented polypropylene (MOPP), biaxially oriented polypropylene (BOPP), or sequentially or simultaneously biaxially oriented polypropylene (SBOPP). The backing material can be compostible, degradable, colored, printed, and can be of different surface textures or embossed. Pressure sensitive adhesive is coated onto one side of the backing and a release coating (a low adhesion backsize (LAB) coating) is optionally coated on the opposite side to allow the tape to unwind from itself when wound in a roll.

In applications in which a printed tag is desirable, the release coatings on the pressure sensitive adhesive tape should be selected to provide secure anchorage of the ink to the LAB. Additionally, the release coating composition can be compatible with the adhesive composition and does not degrade the adhesive properties of the tape such as by being transferred to the adhesive composition.

Release coating compositions for the LAB layer of tapes in roll form may include silicone, alkyl, or fluorochemical constituents, or combinations as the release-imparting component. Useful release coating compositions for printable tapes include silicone-containing polymers, such as silicone polyurethanes, silicone polyureas and silicone polyurethane/ureas, such as those described in U.S. Pat. Nos. 5,214,119; 5,290,615; 5,750,630; and 5,356,706, and silicone acrylate grafted copolymers described in U.S. Pat. Nos. 5,032,460; 5,202,190; and 4,728,571. Other useful release coating compositions include fluorochemical-containing polymers such as those described in U.S. Pat. No. 3,318,852, and polymers containing long alkyl side chains such as polyvinyl N-alkyl carbamates (e.g., polyvinyl N-octadecyl carbamates) as described in U.S. Pat. No. 2,532,011, and copolymers containing higher alkyl acrylates (e.g., octadecyl acrylate or behenyl acrylate), such as those described in U.S. Pat. No. 2,607,711, or alkyl methacrylates (e.g., stearyl methacrylate) such as those described in U.S. Pat. Nos. 3,502,497 and 4,241,198, where the alkyl side chain includes from about 16 to 22 carbon atoms.

These release polymers can be blended with each other and with thermosetting resins or thermoplastic film forming polymers to form the release coating composition. In addition, other additives may be used in the release coating compositions such as fillers, pigments, wetting agents, viscosity modifiers, stabilizers, anti-oxidants, and cross-linking agents.

Numerous other layers can be added to the tape, such as primers to increase adhesive layer adhesion to the backing layer. Also, printed material can be located on the first side of the backing layer under or over the adhesive, or on the second side of the backing layer under or over any LAB layer. This printed material can be any information like advertising or instructions. Also, an additional flood layer of ink or similar coating can be used to alter the opacity of the tape. The tape could contain deodorants, perfumes, antistatic materials, and encapsulated cleaning chemicals. Also, the release properties of the backing can be modified such that the backing and the adhesive cooperate to achieve desired unwind characteristics. The release properties of the backing can be modified by applying a low surface energy composition, priming, corona discharge, flame treatment, roughening, etching, and combinations.

Many types of adhesives can be used. The adhesive can include hotmelt-coated formulations, transfer-coated formulations, solvent-coated formulations, water-based, and latex formulations. Examples of adhesives useful in the invention include those based on general compositions of polyacrylate; polyvinyl ether; diene-containing rubber such as natural rubber, polyisoprene, and polyisobutylene; polychloroprene; butyl rubber; butadiene-acrylonitrile polymer; thermoplastic elastomer; block copolymers such as styrene-isoprene and styrene-isoprene-styrene block copolymers, ethylene-propylenediene polymers, and styrene-butadiene polymers; poly-alpha-olefins; amorphous polyolefins; silicones; ethylene-containing copolymers of vinyl acetate, ethylacrylate, and ethyl methacrylate; polyurethanes; polyamides; epoxies; polyvinylpyrrolidone and vinylpyrrolidone copolymers; polyesters; and mixtures of the above. Additionally, the adhesives can contain additives such as tackifiers, plasticizers, fillers, antioxidants, stabilizers, pigments, diffusing particles, curatives, and solvents.

Useful adhesives include pressure sensitive adhesives. Pressure sensitive adhesives are normally tacky at room temperature and can be adhered to a surface by application of, at most, light finger pressure. A general description of useful pressure sensitive adhesives may be found in Encyclopedia of *Polymer Science and Engineering*, Vol. 13, Wiley-Interscience Publishers (New York, 1988). Additional description of useful pressure sensitive adhesives may be found in *Encyclopedia of Polymer Science and Technology*, Vol. 1, Interscience Publishers (New York, 1964).

The invention can be used in combination with various printing systems, such as flexographic, thermal transfer, and ink jet, and the system can be mounted to a case sealer. In one embodiment, the invention is an applying mechanism which applies a length of tape as a tag onto two adjacent sides of an object such as a parallelepipedal container. As shown, the first or leading leg of tape is applied to the front side (facing the direction of box travel). This tape is wrapped around the corner and the second or trailing leg is applied on the adjacent side of a corrugated box as an L-clip. This applying system reduces or eliminates the wrinkles and bubbles that frequently occur in the applied tag. Box corner crushing is reduced or eliminated on poorly constructed and underpacked or overpacked boxes by using adjustable applying pressure as discussed below. The selection of tape depends on the selection of object and the desire end use and appearance of the tagged object.

Known mechanisms for applying L-clips include pivoting arms in conjunction with an applying roller. As the applying roller applies the leading leg of tape, wrinkles or bubbles frequently occur. Causes include: the initial tack line of the tape to the box is insufficient, causing tape movement during application; the tape is applied at an angle to the front side of the box (the tape and bottom are not parallel), causing wrinkles as the tape spans the corner of the box; the tape is incorrectly positioned in the applying mechanism; variations in the box construction, such as being out-of-square, damaged, and imperfect due to recycling; and variations in box packing by operators (overpacked or underpacked).

With the system of this invention, the initial tack area of the tape with the box is increased from line contact (at the line of contact between the box and the applying roller) to surface contact (using the vacuum pad) as described below. Also, the trailing leg of the tape is applied to the box with the longitudinal center line of the tape contacting the box first. Then, the tape is wiped out to the edges, making contact with the box from the longitudinal centerline to the transverse edges of the tape. This minimizes and, in some instances, eliminates wrinkles and bubbles.

Referring to FIG. 1, the tape-applying apparatus 10 includes a base 12, which can be mounted on a support frame (not shown). The apparatus 10 can be enclosed in any known manner, and the apparatus 10 can be located adjacent a case sealer (not shown). If the tape is to be printed, a printer 13 can be mounted on or adjacent the base 12. The tape path through the apparatus 10, and the major components of the apparatus 10, are as follows. The precise location of the components can vary. Some can reside either above or below the base 12.

The tape 14 is unwound from a tape roll 16 mounted on a spindle 18 on the base 12. There are several rollers 20 at the beginning of the tape path through the tape-applying apparatus 10. As shown in FIG. 1, after passing around the rollers 20 and passing the printer 13, the tape 14 passes around an adjustable idler roller 22. The idler roller 22 is adjustable to accommodate changes in the desired tag length. By moving the idler roller 22, the downweb tape path length changes to accommodate desired changes in the tag length. From the idler roller 22, the tape 14 passes around a dancer roller 24. The dancer roller 24 is mounted at the free end 26 of a dancer arm 28 which pivots around a fixed end 30. As the dancer arm 28 moves the dancer roller 24 away from the idler roller 22 and the roller 32, it accommodates variations in the tape length.

After passing around rollers 32, 34, the tape 14 passes around a one-way tension roller 36. The one-way tension roller 36 performs two functions. It provides web tension at cut-off for a clean straight cut, and it provides web tension on the tape 14 to prevent the tape from moving or dispensing as the applying arm 40 (discussed below) returns to its home position.

From the tension roller 36, the tape 14 moves past a backup roller 38 that is part of an adjustable backup roller assembly. As shown, the backup roller 38 is adjustably mounted within a slot 39 on the base 12 to accommodate changes in the leading leg of tape 14 applied to the front of the box 9, such as from 3.5 cm–15.2 cm (1.38 in–6.0 in). By changing the location of the backup roller 38, the distance between the eccentric roller 46 (discussed below) and the backup roller 38 changes. This position change allows aligning the leading cut edge of the tape with its line of contact with the applying roller to assure proper wiping of the leading edge of the tape on the box.

Figure 5:
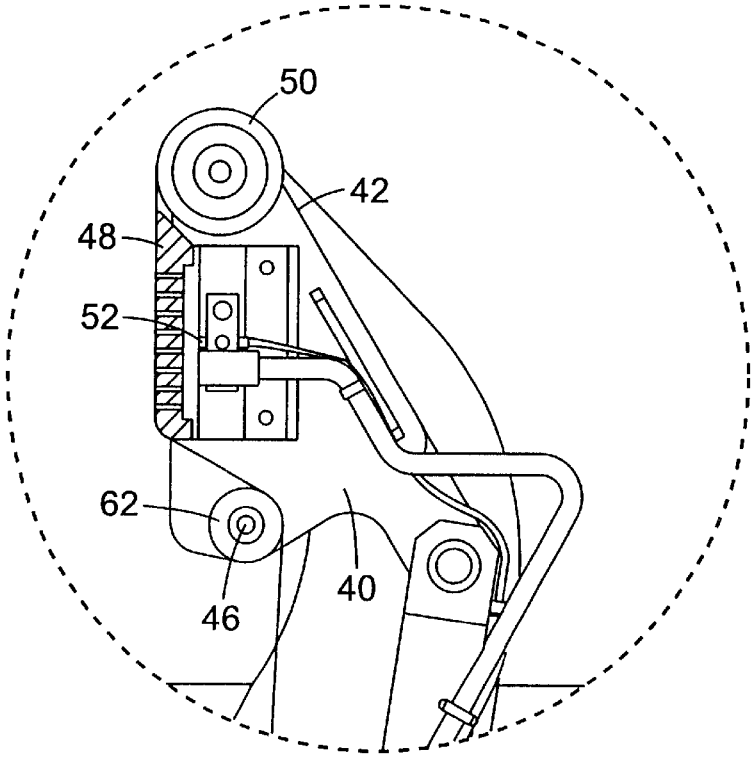
FIG. 5 is an enlarged view of the applying mechanism of FIG. 1.

After leaving the backup roller 38, the tape 14 travels to the applying mechanism. As best shown in FIGS. 1 and 5, the applying mechanism includes a pivotable applying arm 40 having a free end 42 and a fixed end 44. As shown, the applying arm 40 is bent, or L shaped, although it can be other shapes. An eccentric wrap roller 46, a vacuum pad 48, an applying roller 50, and a sensor 52 are all mounted on the free end 42 of the applying arm 40. Together, these components form a vacuum arm assembly which can pivot relative the applying arm 40 to ensure that the vacuum pad 48 remains parallel to the front side of the box during contact. The sensor 52 is located adjacent the vacuum pad 48 to sense registration marks on the tape 14 to control the cutting of the tape 14 to form a tag, as discussed below. The sensor 52 is located at the bottom of the vacuum pad 48 if the registration marks are located on the bottom of the tape 14. (The marks, and therefore the sensor 52, can be located at the top of the tape.)

The applying arm assembly rests on a mechanical stop, such as an applying arm bumper 66, in its home position. The bumper 66 is mounted on an eccentric shaft. By rotating the bumper 66 and shaft, the applying arm 40 pivots back for correct leading leg length. The bumper 66 can be rotated to locate it in the correct position for the desired leading leg length. This movement, combined with adjusting the backup roller 38 to align the leading edge of the tape properly on the applying roller will ensure that the leading leg is applied and wiped properly on the box 9. The applying arm 40 pivots and maintains the front side of the box 9 parallel with the face of the vacuum pad 48, using a bar linkage.

The applying roller 50 can be coated with 30 durometer rubber. This surface provides good tape wipedown. Other known coatings and surfaces that provide good wipedown also can be used. As the box 9 pushes on the applying roller 50, the applied tape is buffed or wiped on the front side of the box. The applying roller 50 does not wipe the tape 14 around the corner of the box 9. As the applying roller 50 is pushed, by the box, around the corner of the box, the internal web tension of the tape 14 pulls the applying roller 50 off the box approximately 0.317–0.952 cm (0.125–0.375 in). This provides for substantially wrinkle-free side application. (If the applying roller 50 was on the box 9 and the tape was being applied at an angle to the bottom surface (out of parallel), wrinkles or bubbles would be wiped into the tape.)

The vacuum pad 48 holds the tape 14 in place adjacent the applying roller 50 to ensure that the leading leg of the tape 14 is tacked in the proper position for substantially wrinkle-free application onto the front side of the box 9. With the applying roller 50 doing the wiping on the front side of the box, the vacuum pad 48 need only apply the tape 14. Also, the vacuum pad 48 prevents the tape 14 on the applying roller 50 from sagging or moving between applications. Without vacuum, the tape 14 could sag or move from the proper position such as by vibration or air currents. The vacuum pad 48 holds the tape 14 planar to the front of the box 9, parallel to the top and bottom edges, throughout the application. The vacuum creates web tension between the vacuum pad 48 and the tension roller 36 described below, as the applying arm 40 returns to its home position, and it holds the tape 14 (for the next tag) in a proper vertical position during and after the tape is cut from the tape roll 16 to provide a tag.

The vacuum pad 48 has a significant surface area that faces the tape. The size of the vacuum pad 48 and the size of the effective vacuum area need only be sufficient to tack and hold the tape 14 in position. Any size or shape that accomplishes this can be used. This surface area can be as wide as the tape 14 and can extend up to the total length of the tape being applied to the box. For example, the surface area can be 22.9 $cm^2$ (9 $in^2$).

The vacuum pad 48 could be biased by any mechanism, such as by springs (not shown). This permits the vacuum pad 48 to conform to the front of the box as the tape 14 is being applied to further minimize wrinkles by better accommodating overpacked boxes. The spring loading can be accomplished by several independent springs (or other biasing devices) in various locations, such as at the corners of the vacuum pad to accommodate box variations.

The vacuum can be supplied to the vacuum pad 48 with a vacuum ejector or similar device. A flow control device controls the amount of vacuum supplied to the vacuum pad 48. A vacuum pump could also be used. By controlling the air flow to the vacuum ejector the amount of vacuum to the vacuum pad 48 can be increased or decreased. This vacuum and the amount of tension on the one-way tension roller 36 are directly proportional to box corner crushing. As vacuum and tension roller forces increase, the force of the applying roller on the corner of the box increases. (The applying roller 50 contacts the front side of the box up to the corner. The applying roller and the tape tension combine to provide a force on the corner of the box. Boxes that are well packed and have adequate corner support will not have corner crushing. As box quality decreases or boxes are underpacked, corner crushing could occur. By adjusting the flow control on the vacuum ejector, and reducing the tension roller force, crushed box corners can be reduced or eliminated. Also, by using an adjustable vacuum pad or interchangeable pads with different effective vacuum areas, the amount of vacuum can be controlled to ensure that proper amount of vacuum is applied to the tape 14.

The eccentric wrap roller 46 rotates on a shaft 62 and is located in the tape path before the vacuum pad 48. The eccentricity of the eccentric wrap roller 46 is created by mounting it on the vacuum arm assembly on the applying arm 40 on an axis that is not perpendicular with the base 12. In the illustrated embodiment, it is 0.15 cm (0.06 in) offset from perpendicular. The wrap roller 46 and shaft 62 can be rotated to track the tape 14 up or down into the proper position on the vacuum pad 48. Once adjusted, the tape 14 will be correctly positioned on the vacuum pad 48 for substantially wrinkle-free application. The eccentric wrap roller 46 eliminates the problem of the tape 14 walking or misaligning on the vacuum pad 48 by locating the tape 14 at the proper position. This accommodates any variations in the tape path caused by misalignment in any or all of the other rollers 20, 22, 24, 32, 34, 36, 38.

Figure 6:
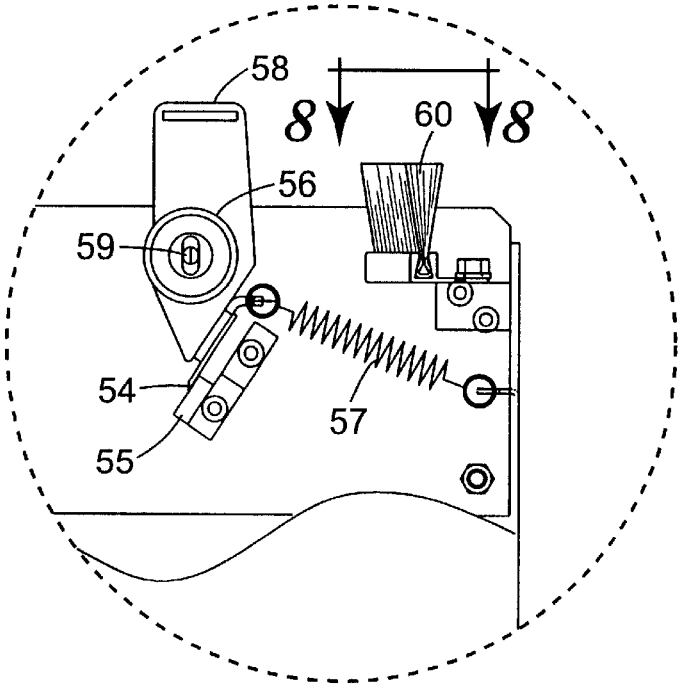
FIG. 6 is an enlarged view of the cutting mechanism of FIG. 1 in the home position.
Figure 7:
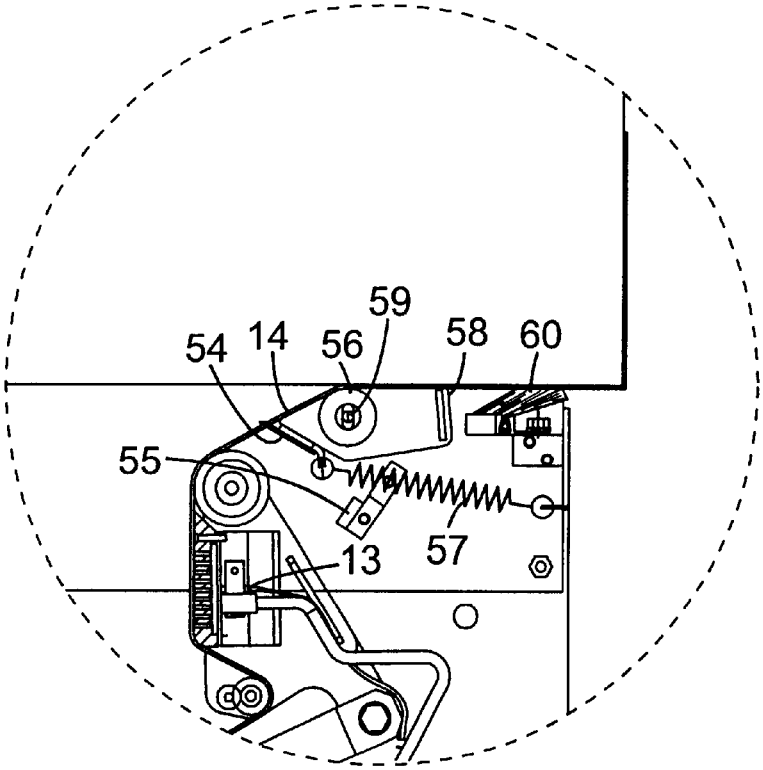
FIG. 7 is an enlarged view of the cutting mechanism of FIG. 1 in the cutting position.

The apparatus 10 also includes a cutoff blade or knife 54 mounted on a bracket or arm 58, best shown in FIG. 6. The arm 58 pivots on the base 12 around a shaft 59, which is mounted perpendicularly on the base 12. The knife 54 rests against a pad 55, which serves as a stop when the knife 54 is in its home position (as shown in FIG. 6). The knife is biased toward its home position by a spring 57, although other biasing devices could be used. The pad 55 can be porous to hold oil or other material to lubricate the knife 54 and prevent adhesive from the tape 14 from accumulating on the knife.

A convex wiping roller 56 is mounted for rotation on the same shaft 59 as the arm 58. The convex wiping roller 56 can be located 0.30 cm (0.12 in) from the plane which is created by lower and upper box guides (not shown) behind the applying arm assembly. As the applying roller 50 moves around the corner of the box 9, the tape 14 is pulled over the convex wiping roller 56, which curves the tape 14 from the centerline out to both edges. This curvature allows the longitudinal center of the trailing leg of the tape 14 to be applied to the box first. Alternative configurations can be used to wipe the tape from the longitudinal center toward its transverse edges.

Figure 8:
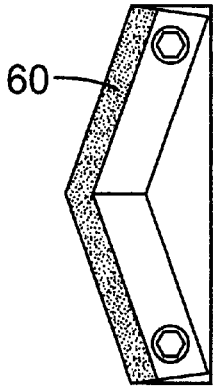
FIG. 8 is a view of the wiping brush taken along line 8—8 of FIG. 6.

A V-shaped buffer or wiper, such as a brush 60, is fixed on the base 12 downstream of the arm 58. The V-shaped wiping brush 60 wipes the centerline of the trailing leg of the tape 14 to the box 9 first and then wipes out to both transverse edges. This wiping action reduces or eliminates bubbles and wrinkles in the tape applied to the box. This action is similar to applying tape by hand. A person would first apply the center and wipe out to the edges to reduce wrinkling. The use of the convex wiping roller 56 and the V-shaped wiping brush 60 is especially important when applying difficult-to-handle tapes, such as thin (in the range of 89 microns (3.5 mil) or less), wide (in the range of 7.5 cm (3 in) or more) tapes. The V-shaped wiping brush 60 is located and oriented with respect to the box path such that the apex of the V contacts the tape 14 first in the longitudinal center of the tape to cause the center of the tape to be applied on the box 9 before the transverse edges of the tape are applied to the box. The shape of the wiping brush 60 is best shown in FIG. 8. Its properties, such as stiffness, angle of the V, and angle of interference, can be selected to accommodate different applications. Alternative versions of wiper can be used to wipe the tape from the longitudinal center toward its transverse edges.

The cut-off knife 54 is mounted to a pivoting mounting bracket, such as the arm 58, that moves into the correct cut position by the moving box. Alternatively, other known cutting devices, including hot wire cutters, can be used. As the tape 14 is applied to the box 9, a registration mark located on the tape 14 can be sensed by the fiber-optic sensor 52. The applying arm assembly is pulled back by any conventional device such as an air cylinder 64, which brings the tape path into the knife 54 for cutting. The tape 14 is cut and applied with the wiping roller 56 and the V-shaped wiping brush 60.

When the sensor 52 senses a registration mark, a signal is sent to a solenoid valve (not shown), which energizes the air cylinder 64 to pull the applying arm 40 back. This pulls the tape 14 against the knife 54 to cut the tape 14 as the convex wiping roller 56 and the V-shaped wiping brush 60 wipe down the tape. The length of the leading leg of the tag is governed by the position of the applying arm 40. The length of the trailing leg is governed by the overall desired length of the tag and the position of the applying arm 40. By adjusting the initial location of the applying arm 40, the length of the trailing leg of the tag can increase or decrease.

The operation of this apparatus 10 is shown in FIGS. 1–4. In the first stage (FIG. 1) the box 9 first contacts the applying roller 50 and vacuum pad 48. In this stage, all of the components are in a rest or home position. A length of tape 14 is placed on the front wall of the box 9. The dancer roller 24 location and the location of the idler roller 22 have been adjusted by an operator to select the total length of the tag. The locations of the rollers 32, 34 and tension roller 36 are fixed. The backup roller 38 has been positioned by the operator and the applying arm 40 is positioned against the bumper 66 to select the length of the leading leg of the tag. The vacuum pad 48 is applying the tape 14 to the front side of the box 9.

As the box 9 moves along (FIG. 2), the tape 14 adheres to the front wall of the box and box movement pulls additional tape 14 through the tape path. The vacuum pad 48 applies the leading leg of the tape 14 to the front side of the box 9 and the applying roller 50 will wipe the tape on the front of the box 9. As the box 9 continues to move in the direction of the arrow, it pushes against the applying roller 50 and vacuum pad 48, pivoting the applying arm 40 and moving it in toward the right in the figure. Contrary to known systems, the box 9 moves toward the tape 14 on the vacuum pad 48 and pushes the vacuum pad -the vacuum pad slides relative to the surface of the box to apply the tape. As the applying roller reaches the corner of the box, tension in the tape causes the applying roller 50 to move away from the side of the box. At this point, the box has just contacted, but has not pivoted, the mounting arm 58 holding the knife 54.

Figure 3:
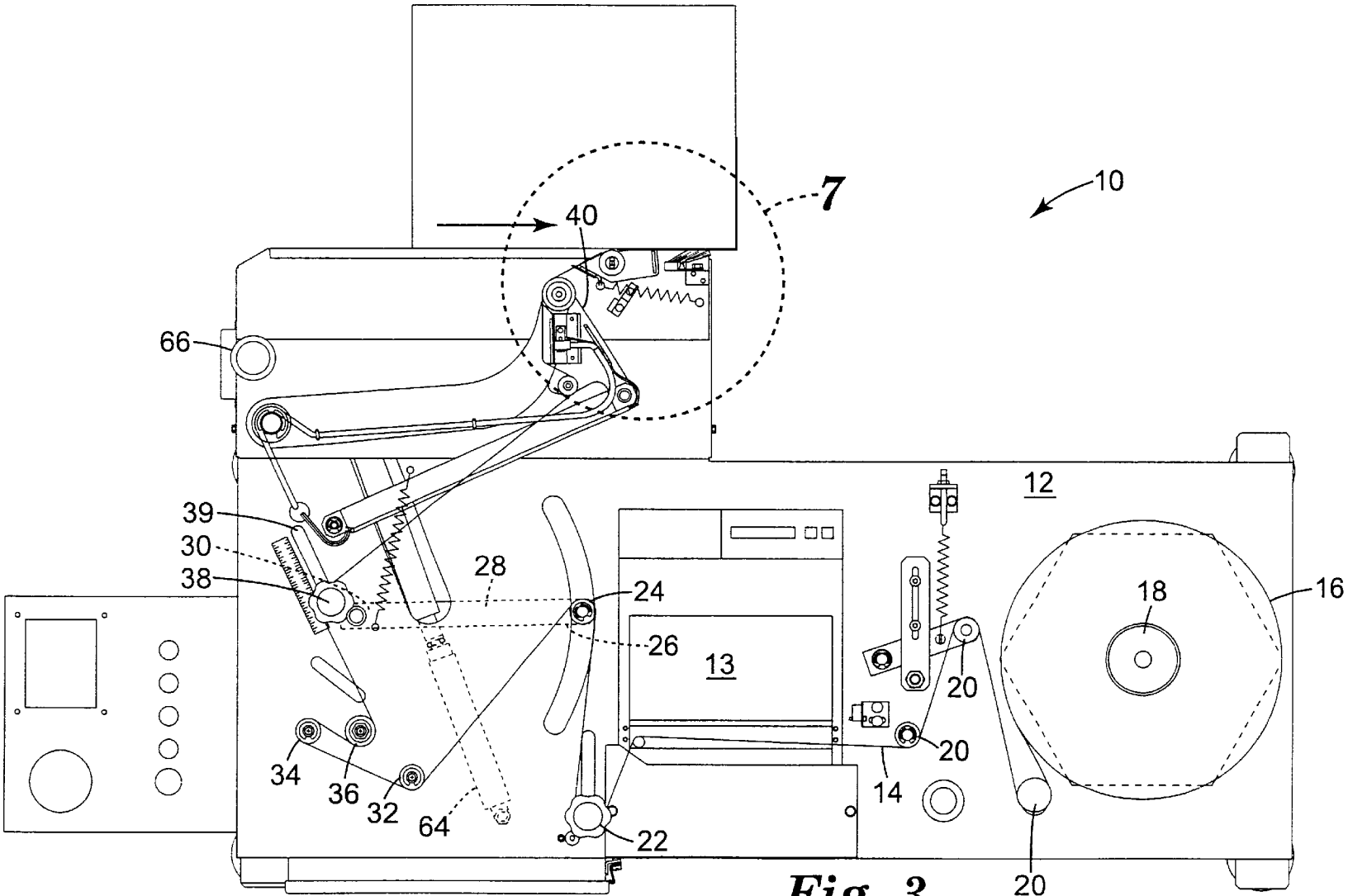
FIG. 3 is a top view of the apparatus of FIG. 1 with a box engaging the cutting mechanism.
Figure 4:
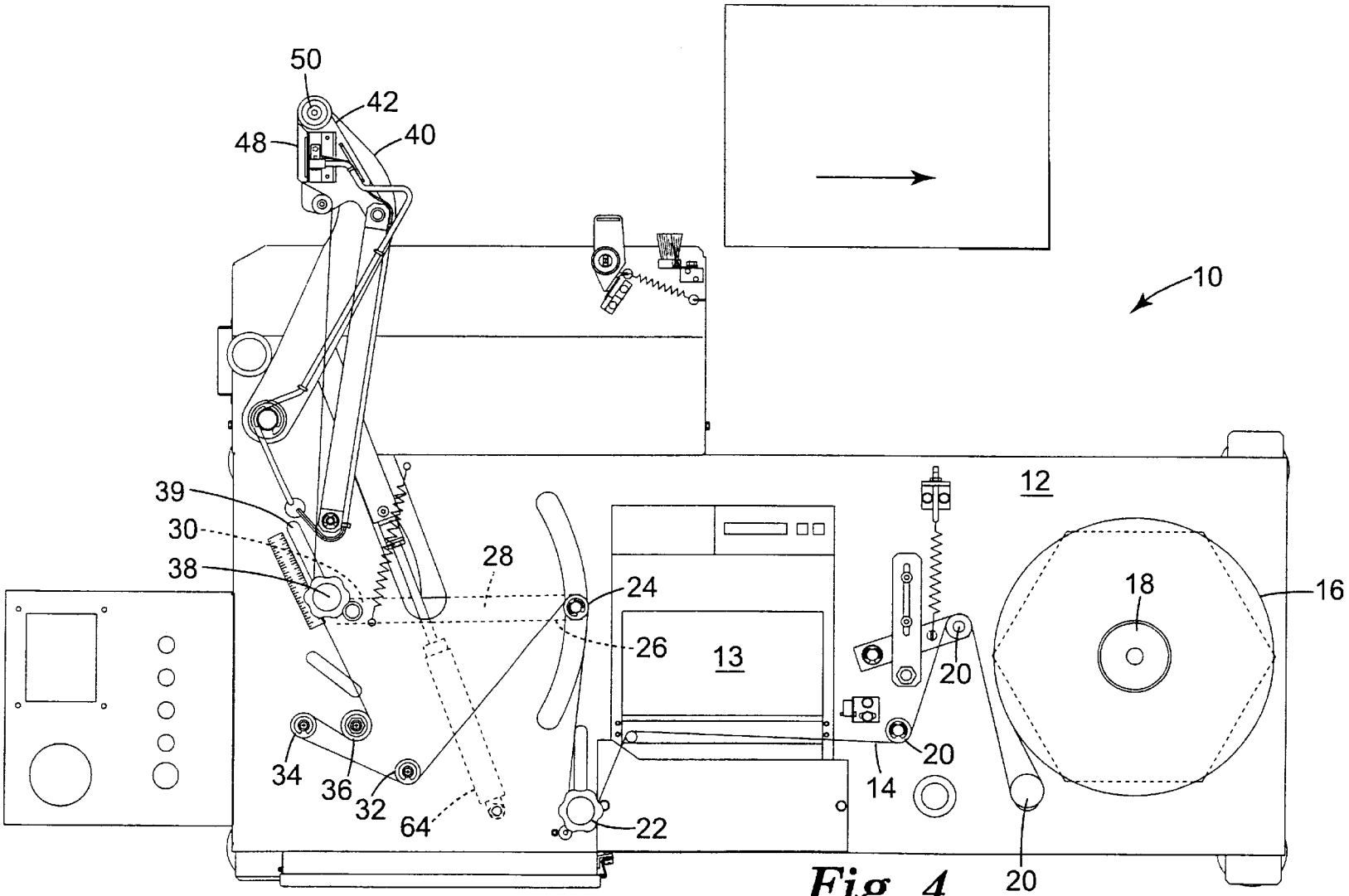
FIG. 4 is a top view of the apparatus of FIG. 1 with the various components in the home position and the tag applied to the box.

In the next stage, shown in FIG. 3, the box 9 has continued past the pivoting mounting arm 58 and the box causes the mounting arm to pivot to present the knife 54 to the tape 14 to cut the tape to form a tag when the proper length of tape is attained. The wiping roller 56 and the wiping brush 60 begin wiping the trailing leg of tape onto the side of the box. When the registration mark is sensed by the sensor 52, the air cylinder 64 is energized to pull the applying arm into the cutting position. The air cylinder 64 pulls the applying roller 50 from the position in FIG. 2 to the position in FIG. 3. At the same time, the knife 54 cuts the tape 14 in the path between the applying roller 50 and the convex wiping roller 56. As the tape 14 is cut, it forms a tag. The box 9 is also moving past the V-shaped wiping brush 60 which wipes the tape 14 onto the side of the box 9. The wiping brush 60 contacts the longitudinal centerline of the trailing leg of the tag first, then wipes toward the transverse sides of the tape 14. From here, the air cylinder 64 is energized, moving the applying arm to its home position, and the other components also return to their home position (FIG. 4). The tag is now applied onto the box 9.

There are numerous advantages to this apparatus 10. The leading leg of tape is applied parallel to the first side of the box to reduce or eliminate wrinkles. Tape 14 is properly held in the correct position throughout its application by the vacuum pad and eccentric wrap roller. Also, the trailing leg of tape is applied from the tape centerline to the tape edges for bubble and wrinkle reduction or elimination. The length of the leading leg of the tag is adjusted using the adjustable backup roller and eccentric applying arm bumper. And by adjusting the box corner applying force, corner crushing on poor box constructions or underpacked boxes can be reduced or eliminated.

Various changes and modifications can be made in the invention without departing from the scope or spirit of the invention. Although the embodiments described relate to applying tape onto adjacent perpendicular sides of objects, tape can be applied using this apparatus 10 on other-shaped objects. For example, the object could have nonperpendicular sides. The surface of the vacuum pad could be angled or could pivot to accommodate various configurations. Also, the invention can be used, with modifications to apply tape to a single side of an object, by selecting various of its components. All cited materials are incorporated into this disclosure by reference.

What is claimed is:

1. An apparatus for applying a length of tape onto at least one side of an object comprising:

means for transporting the tape toward the object;

means for applying the tape onto the side of the object comprising:

means for contacting the tape to the side of the object;

means for wiping the tape from a longitudinal centerline toward transverse edges of the tape to minimize bubbles under the tape and wrinkles in the tape; and means for cutting the tape to form a tag.

2. The apparatus of claim 1 further comprising means for holding the tape during application.

3. An apparatus for applying a length of tape onto adjacent sides of an object comprising:

a base;

means, mounted on the base, for transporting the tape toward the object;

means for moving the object along a direction means for applying the tape onto adjacent first and second sides of the object, wherein the first side and second side have a common edge and wherein the first side is substantially perpendicular to the direction of travel of the object and the second side is angled with the first side, wherein the means for applying comprises:

means for contacting the tape to the first side of the object with a longitudinal centerline of the tape substantially perpendicular to the common edge;

means for contacting the tape to the second side of the object with the longitudinal centerline of the tape substantially parallel to the direction of object travel; and means for wiping the tape from the longitudinal centerline toward transverse edges of the tape to minimize bubbles under the tape and wrinkles in the tape; and means for cutting the tape to form a tag.

4. The apparatus of claim 3 wherein the means for contacting the tape to the first side of the object comprises an applying roller mounted on a pivotable applying arm, wherein the applying arm pivots in response to the force of the object.

5. The apparatus of claim 3 wherein the means for applying further comprises means for holding the tape during application, and wherein the means for contacting the tape to the first side of the object comprises placing the tape on the first side.

6. The apparatus of claim 5 wherein the means for holding comprises a vacuum pad having an effective vacuum area sufficient to hold the tape in position.

7. The apparatus of claim 6 wherein the means for holding further comprises an eccentric wrap roller which locates and aligns the tape on the vacuum pad to ensure proper orientation of the tape on the object and to provide a substantially wrinkle-free tag.

8. The apparatus of claim 3 wherein the means for wiping comprises means for contacting the tape and causing the center of the tape to be applied on the second side of the object before the transverse edges of the tape are applied to the second side of the object.

9. The apparatus of claim 8 wherein the means for wiping comprises a convex roller which contacts the tape and curves the tape around the surface of the convex roller to cause the center of the tape to be applied on the object before the transverse edges of the tape are applied to the object.

10. The apparatus of claim 9 further comprising a shaft located on the base adjacent the object path and a pivoting mounting arm mounted on the shaft, wherein the means for cutting is mounted on the mounting arm and the convex roller is mounted on the shaft, and wherein the pivoting mounting arm has a free end contactable by the object to move the means for cutting into the correct cut position.

11. The apparatus of claim 8 wherein the means for wiping comprises a V-shaped wiper located with respect to the path of the object such that the apex of the V contacts the tape first in the longitudinal center of the tape to cause the center of the tape to be applied on the object before the transverse edges of the tape are applied to the object.

12. The apparatus of claim 11 wherein the V-shaped wiper comprises a brush.

13. The apparatus of claim 3 further comprising means for adjusting the length of the leading leg of the tag comprising an adjustable backup roller and an applying arm bumper, both located on the base along the tape path, and means for adjusting the applying arm bumper position.

14. The apparatus of claim 6 further comprising means for adjusting the applying force to reduce crushing the corners of the object, wherein the means for adjusting comprises at least one of (a) means for controlling the amount of vacuum to the vacuum pad; and (b) means for controlling the amount of tension on the tape.

15. The apparatus of claim 3 wherein the object is a parallelepipedal box, the first side is perpendicular to the direction of object travel, and the second side is substantially perpendicular to the first side.

16. A method for applying a length of tape onto adjacent sides of an object comprising:

transporting the tape toward the object;

moving the object along a direction;

applying the tape onto adjacent first and second sides of the object, wherein the first side and second side have a common edge and wherein the first side is substantially perpendicular to the direction of travel of the object and the second side is angled with the first side; wherein the applying step comprises contacting the tape to the first side of the object by placing the tape on the first side with a longitudinal centerline of the tape substantially perpendicular to the common edge and contacting the tape to the second side of the object with the longitudinal centerline of the tape substantially parallel to the direction of object travel; and wherein the applying step further comprises at least one of:

(a) wiping the tape with a wiping means from the longitudinal centerline toward transverse edges of the tape to minimize bubbles under the tape and wrinkles in the tape; and (b) holding the tape during application to ensure that the tape is tacked in the proper position for substantially wrinkle-free application; and cutting the tape to form a tag.

17. The method of claim 16 further comprising adjusting the length of the leading leg of the tag.

18. The method of claim 16 further comprising adjusting the applying force to reduce crushing the corners of the object, wherein the adjusting step comprises at least one of (a) holding the tape using vacuum and controlling the amount of vacuum; and (b) controlling the amount of tension on the tape.

* * * * *

UNITED STATES PATENT AND TRADEMARK OFFICE

CERTIFICATE OF CORRECTION

PATENT NO. : 6,537,406 B1
DATED : March 25, 2003
INVENTOR(S) : Jensen, Van E. Jr.

It is certified that error appears in the above-identified patent and that said Letters Patent is hereby corrected as shown below:

Title page,
Item [56], References Cited, U.S. PATENT DOCUMENTS,
"5,614,928 A 3/1997 Matsuda et al." should read -- 5,614,928 A 3/1997 Matsuda --;
and please add
-- 4,909,885 3/1990 Swenson --

Column 1,
Line 39, "umbers" should be -- numbers --.
Line 44, after "box." insert -- This is typically known as the ability to print variable information onto a label before it is applied onto a box. --.

Column 5,
Line 61, "desire" should be -- desired --.

Column 7,
Line 26, "30" should not be bolded.

Column 11,
Line 4, insert -- ; -- following "direction".

Signed and Sealed this

Thirtieth Day of December, 2003

JAMES E. ROGAN
*Director of the United States Patent and Trademark Office*